US010870511B2

(12) United States Patent
Eckert et al.

(10) Patent No.: US 10,870,511 B2
(45) Date of Patent: Dec. 22, 2020

(54) FLIP-TOP CONTAINER WITH TOOTH-SHAPED SIDE PERFORATIONS

(71) Applicant: NESTEC S.A., Vevey (CH)

(72) Inventors: Sebastian Eckert, Frankfurt (DE); Rafael Schraml, Konolfingen (CH); Marco Vierling, Mainz (DE); Martin Zelosko, Wiesbaden (DE)

(73) Assignee: Societe des Produits Nestle S.A., Vevey (CH)

( * ) Notice: Subject to any disclaimer, the term of this patent is extended or adjusted under 35 U.S.C. 154(b) by 0 days.

(21) Appl. No.: 15/524,002

(22) PCT Filed: Nov. 3, 2015

(86) PCT No.: PCT/EP2015/075610
§ 371 (c)(1),
(2) Date: May 3, 2017

(87) PCT Pub. No.: WO2016/071346
PCT Pub. Date: May 12, 2016

(65) Prior Publication Data

US 2017/0334600 A1 Nov. 23, 2017

(30) Foreign Application Priority Data

Nov. 4, 2014 (EP) ..... 14191651

(51) Int. Cl.

| | |
|---|---|
| ***B65D 5/54*** | (2006.01) |
| ***B65D 5/42*** | (2006.01) |
| ***B65D 77/02*** | (2006.01) |
| ***B65B 7/26*** | (2006.01) |
| ***B65B 43/10*** | (2006.01) |
| ***B65B 61/02*** | (2006.01) |

(Continued)

(52) U.S. Cl.
CPC ..... *B65D 5/5425* (2013.01); *B65B 7/26* (2013.01); *B65B 43/10* (2013.01); *B65B 61/02* (2013.01);

(Continued)

(58) Field of Classification Search
CPC .... B65D 5/5425; B65D 5/4266; B65D 5/543; B65D 5/66; B65D 77/02; B65D 85/70;

(Continued)

(56) References Cited

U.S. PATENT DOCUMENTS

| | | | |
|---|---|---|---|
| 2,951,627 | A | 9/1960 | Wenzel |
| 2,967,010 | A | 1/1961 | Cuffey, Jr. et al. |

(Continued)

FOREIGN PATENT DOCUMENTS

| | | |
|---|---|---|
| FR | 2197774 | 3/1974 |
| JP | 63147421 | 9/1988 |
| JP | 2006225007 | 8/2006 |

*Primary Examiner* — Christopher R Demeree
(74) *Attorney, Agent, or Firm* — K&L Gates LLP

(57) ABSTRACT

The present invention relates to a container (1) comprising a bottom panel (2), a front panel (3), two side panels (4), a rear panel (5), and a top panel (6). The front panel (3) and the two side panels (4) each comprises a perforation line (7) so that a hingedly connected lid (8) is obtained when the perforation lines (7) are broken. The perforation line (7) in the front panel (3) is a row of perforations (23) arranged along a line or curve which forms an edge (24) of the lid (8) after the perforations (23) have been broken. Each of the perforation lines (7) in the side panels (4) is a row of perforations (23) each comprising two coherent first and second cuts (26,27) with a blunt angle (α) there between. These perforations (23) are arranged to provide a row of tooth-shaped regions (25), where each tooth-shaped region (25) is delimited by a first cut (26) and a second cut (27), respectively, from two mutually adjacent but non-coherent perforations (23). The first cuts (26) are arranged parallel to each other but staggered so that they are not arranged along one line.

16 Claims, 6 Drawing Sheets

(51) Int. Cl.
*B65D 5/66* (2006.01)
*B65D 85/00* (2006.01)

(52) U.S. Cl.
CPC ..... *B65D 5/4266* (2013.01); *B65D 5/543* (2013.01); *B65D 5/66* (2013.01); *B65D 77/02* (2013.01); *B65D 85/70* (2013.01)

(58) Field of Classification Search
CPC .. B65D 5/54; B65B 7/26; B65B 43/10; B65B 61/02
USPC ..... 229/200, 225, 237, 227, 920, 930; 428/43
See application file for complete search history.

(56) References Cited

U.S. PATENT DOCUMENTS 3,580,465 A * 5/1971 Davies ..... B65D 5/606 229/117.34
4,325,482 A * 4/1982 Feeser ..... B65D 5/5435 229/224
4,688,677 A * 8/1987 Roccaforte ..... B65D 5/5415 229/160.1
5,036,982 A * 8/1991 Aston ..... B65D 5/543 229/160.1
5,143,213 A * 9/1992 Moore ..... B65D 5/42 206/268
5,161,733 A * 11/1992 Latif ..... B65D 85/10 206/268
5,325,989 A * 7/1994 Karalus ..... B65D 5/543 229/185.1
5,332,147 A * 7/1994 Sorenson ..... B65D 5/6626 229/114
5,673,849 A * 10/1997 Stone ..... B65D 5/0263 229/130
9,439,490 B2 * 9/2016 DeGeorge ..... A45D 7/04
2003/0116614 A1 6/2003 Block et al.

* cited by examiner a)

b)

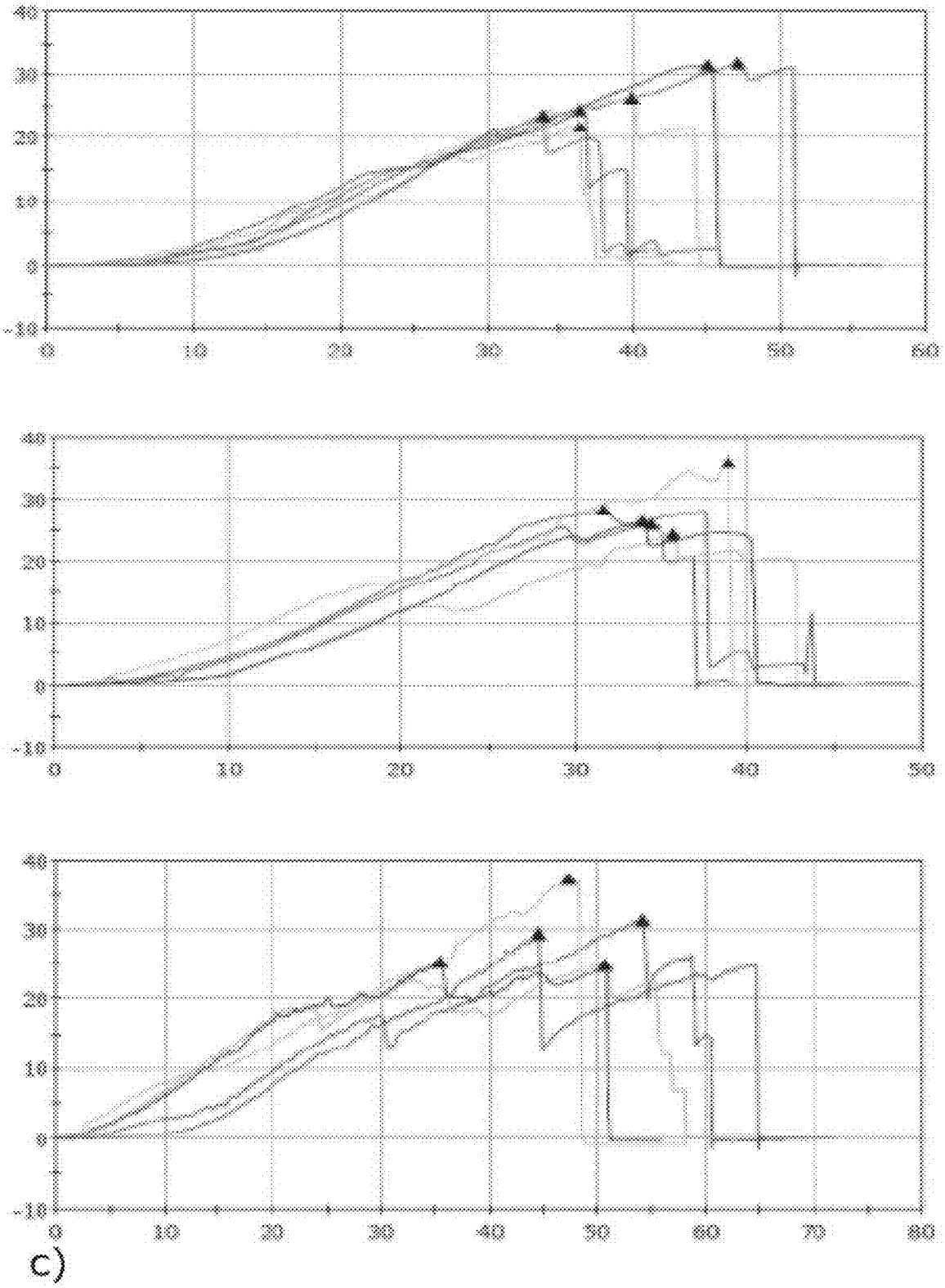
Fig. 4, continued

| Sample | Force [N] |
|---|---|
| 1 | 31.77575 |
| 2 | 24.56221 |
| 3 | 26.38582 |
| 4 | 21.94704 |
| 5 | 31.42092 |
| 6 | 23.64637 |
| Maximum | 31.77575 |
| Median | 25.47402 |
| Minimum | 21.94704 |
| Average | 26.62302 |
| STD | 4.11336 |

7 teeth

| Sample | Force [N] |
|---|---|
| 1 | 25.998 |
| 2 | 28.384 |
| 3 | 36.058 |
| 4 | 24.391 |
| 5 | 26.474 |
| Maximum | 36.058 |
| Median | 26.474 |
| Minimum | 24.391 |
| Average | 28.261 |
| STD | 4.5851 |

5 teeth

| Sample | Force [N] |
|---|---|
| 1 | 31.445 |
| 2 | 29.511 |
| 3 | 37.3 |
| 4 | 25.021 |
| 5 | 25.39 |
| Maximum | 37.3 |
| Median | 29.511 |
| Minimum | 25.021 |
| Average | 29.733 |
| STD | 5.0327 |

no teeth d)

Fig. 4, continued

FLIP-TOP CONTAINER WITH TOOTH-SHAPED SIDE PERFORATIONS

CROSS REFERENCE TO RELATED APPLICATIONS

The present application is a National Stage of International Application No. PCT/EP2015/075610, filed on Nov. 3, 2015, which claims priority to European Patent Application No. 14191651.0, filed on Nov. 4, 2014, the entire contents of which are being incorporated herein by reference.

FIELD OF THE INVENTION

The present invention relates to containers, and in particular to flip-top containers which are to be opened by manually breaking a perforation line in the material from which the container is made.

BACKGROUND OF THE INVENTION

A container with a hinged lid is often referred to as a flip-top container, flip-top box or flip-top package. Such flip-top containers are used for numerous packaging purposes. A typical use is for storing of food products and typically for content which is to be consumed in portions over a period of time, such as milk powder. However, other uses are also possible. The content of the container may be contained in one or more pouches stored inside the container. An example of a flip-top container is disclosed in U.S. Pat. No. 5,653,384.

In order to enable the opening of the lid of such a container, perforation lines on the front panel and side panels are to be broken, whereas the lid stays hingedly connected to the rear panel of the container. With prior art containers, these perforation lines are typically in the form of rows of straight perforations arranged along what is to form the front and side edges of the lid. In order to be able to open the lid, the perforation lines are intended to be manually pressed along all the sides of the container having the perforation lines. However, it has turned out that many consumers are not aware of this being necessary and therefore intuitively try to open the lid after breaking the perforation line on the front panel only. This easily results in damaging the container during subsequent attempts to pull the lid open.

A further experienced problem with flip-top containers having the type of perforation lines as described above is that the perforations sometimes break during transportation. This may result in unwanted openings to the content of the container, or in the container being in a condition which makes it unsuitable for sale to consumers.

A further problem with flip-top containers as described above is that the opening of the lid can result in damaging of the hinged connection between the lid and the remainder of the container, especially when the container is made from a material which is relatively easily damaged, such as cardboard. This damage typically starts at the ends of the folding line forming the hinge due to the notch effect at that position. The damage is partly due to the tearing force itself applied to open the lid. But it is also due to the bulging of the rear panel, especially for containers made of relatively flexible material. This is particularly a problem, when the container is used to store content which is to be consumed in portions over a period of time. For such use, the repeated opening and closing of the container may result in increased amount of damage. Furthermore, the damage in that case can result in undesired exposure of the content of the container to the surroundings, including the risk of some of the content falling out. On known containers the damage is typically counteracted by applying a reinforcing tape on the inside of the hinge which adds cost and complexity on the production lines. Alternatively or in combination therewith, thicker or more tear-resistant material may also be used, which again adds to the cost.

A further drawback of known flip-top containers is that they often suffer from the drawback of being difficult to re-close.

Hence, an improved container would be advantageous, and in particular a container which is easier to open without damaging the container would be advantageous.

OBJECT OF THE INVENTION

It is an object of the present invention to provide a container which is easier and more intuitive to open without damaging the container than known containers.

It is another object of the present invention to provide a container which provides less resistance to intended manual opening than known containers so that less force is to be applied for opening the container.

It is another object of the present invention to provide a container which provides higher resistance to damage, such as un-intended opening of part of the perforation lines, during transportation.

It is an object of some embodiments of the present invention to provide a container having a higher resistance against damage of the hinged connection between the lid and the remainder of the container during opening of the lid, and in particular during repeated opening and closing of the lid.

It is another object of at least some embodiments of the present invention to provide a container having a lower re-closing force when the container is opened than for known containers.

It is another object of some embodiments of the present invention to provide a container which provides efficient and/or reliable reclosing.

It is a further object of the present invention to provide an alternative to the prior art.

In particular, it may be seen as an object of the present invention to provide a container that solves the above mentioned problems of the prior art.

SUMMARY OF THE INVENTION

Thus, the above described object and several other objects are intended to be obtained in a first aspect of the invention by providing a container comprising a bottom panel, a front panel, two side panels, a rear panel, and a top panel, in which container:

- the front panel and the two side panels each comprises a perforation line,
- the perforation lines in the side panels extend from the rear panel to the front panel, and the perforation line in the front panel extends between and connects the two perforation lines in the side panels, thereby defining a lid,
- the lid comprises the top panel and upper sections of the front panel and of the side panels, respectively, above the perforation lines, which lid, after the perforation lines have been broken, is rotationally moveable around a folding line in the rear panel between a closing position where the lid closes the container, and an open position where an open end of the container is not covered by the lid, said container being further characterized in that the perforation line in the front panel is a row of perforations arranged along a line or curve which forms an edge of the lid after the perforations have been broken, and each of the perforation lines in the side panels is a row of perforations each comprising two coherent first and second cuts with a blunt angle there between, these perforations being arranged to provide a row of tooth-shaped regions, where each tooth-shaped region is delimited by a first cut and a second cut, respectively, from two mutually adjacent but non-coherent perforations, and the first cuts are arranged parallel to each other but staggered so that they are not arranged along one line.

This combination of the two different types of perforation lines in the front panel and in the side panels, respectively, results in a container which is easy to open. This is the case since it is only necessary to open the perforation line in the front panel by manually applying a pressing force thereto, whereupon the perforation lines in the side panels easily open by applying an upwards directed pulling force to the lid. This self-opening effect is due to the tooth-shaped regions and the arrangements thereof. By "self-opening" is preferably meant that it is not necessary to break the side perforations perforations before the opening of the lid is made possible; they break during the first opening of the lid. Several possible designs of the perforations in the side panels have been tested, and those described above have proven to be the most efficient. Hereby a more intuitive opening is obtained compared to other known containers having the perforation lines on the side panels in the form of rows of perforations arranged on a line or curve.

Another object of the invention which is being met by the design as described above is a higher resistance to damage, such as un-intended opening of part of the perforation lines, during transportation as compared to known containers. Experimental tests performed as part of the development of containers according to the invention have shown that the claimed design and arrangement of perforations fulfil this purpose.

In some embodiments of the invention, the perforation lines in the side panels are downwardly sloping from the rear panel. It has been found during experiments performed in relation to the present invention, that at least for some sizes and shapes of containers, it is easier to open the container after having broken the perforation line on the front panel only, if the perforation lines in the side panels are not horizontal.

The tips of the tooth-shaped regions may be directed towards the rear panel. This will result in an easy opening needing less force to be applied than for other orientations of the tips. By "tip" is preferably meant the narrowest end of a tooth-shaped region, i.e. at the end where the distance between to two adjacent perforations is smallest.

The blunt angle between first and second cuts of the perforations in the side panels may be between 145° and 175°, such as between 155° and 165° or between 165° and 175°. Exactly which angle to choose for a given application can be determined e.g. by experimentation or by computer simulations.

The smallest distance between two perforations on the side panels may be between 0.5 and 3 mm, such as between 1 and 2 mm, preferably approximately 1 mm. This distance is preferably to be taken as the smallest distance when measured perpendicular to a first cut of a perforation towards the adjacent perforation. Exactly which distance to choose for a given application will depend on a number of parameters including the thickness and tear strength of the material from which the container is made, the width of the cuts and the overall inclination angle of the perforation lines with respect to horizontal.

The length of the first cuts of the perforations on the side panels may be between 8 and 16 mm, such as 10 to 14 mm, such as 11 to 13 mm.

As for the blunt angles mentioned above, a final design of the tooth-shaped perforation lines can be determined e.g. by experimentation or by computer simulations.

In some embodiments of the invention, at least two parallel and spaced apart transverse cuts are provided at or near a central part of the folding line, the transverse cuts perforating the rear panel through the thickness, and the transverse cuts extending substantially symmetrically across and perpendicular to the folding line.

Studies performed in relation to the present invention have shown that the inclusion of such transverse cuts significantly reduces, or even removes, the bulging of a container; this will be described in more details in relation to the figures. Hereby the damage to the folding line which is observed on known containers can be avoided or at least significantly reduced.

In some embodiments of the invention, embossing lines connect the ends of the transverse cuts. Embossing may also be provided along the folding line in the rear panel. Such embossing is typically provided in the material from which the container is made in order to facilitate the desired folding of the material during opening of the lid. The embossing may e.g. be made by the die cutting tool used to make the sheet material from which the container is typically made.

The number of the transverse cuts may be two, and they are then typically arranged symmetrically around a midpoint of the folding line. The length of the transverse cuts may depend on the size of the container, and an optimal length can be determined e.g. from experiments. Possible total lengths are 20 to 40 mm, such as 20 to 30 mm or 30 to 40 mm.

A container as described above may further comprise an end cut provided near but at a distance from each end of the folding line, the end cuts going through the thickness of the rear panel, and the folding line being perforated between the end cuts and the end of the folding line adjacent to the side panels. The presence of such end cuts have shown to further minimize the risk of damage at the ends of the folding line, because the forces are spread over a larger area and in different directions instead of only one. The end cuts may extend substantially symmetrically across the folding line.

Each of the end cuts may be provided in the form of two linear and coherent sub-cuts arranged non-perpendicular to the folding line. The angle between the coherent sub-cuts may be between 90° and 175°, such as between 100° and 170°, such as between 110° and 150°, such as between 120° and 130°, such as 125°. Alternatively the sub-cuts may be along one line and thus be perpendicular to the folding line; i.e. having an angle of 180°. In an alternative embodiment, the end cuts may be arc-shaped. Exactly which design of the end cuts to use for a given design of a container, including the type and thickness of the material used, can be determined e.g. by experimentation.

In some embodiments of the invention, the folding line may further comprise a row of discontinuous perforations extending along the folding line. This has been found to reduce the re-closing force when the container has been opened. These perforations may further ease the first opening of the lid along the folding line and thereby reduce the risk of bulging which could otherwise induce damage to the folding line as described above.

In presently preferred embodiments of the invention, the contained may further be characterized by:

- the perforation line may extend downwardly sloping from the rear panel in the side panels and horizontally in at least a part of the front panel,
- the front panel may further comprise an inner front part extending above the perforation line in the front panel without being attached to the front panel above the perforation line,
- each side panel may further comprise an inner side part extending above the perforation line in the side panel without being attached to the side panel above the perforation line, the upper margin of each of the inner side parts extending downwardly sloping towards the rear panel, and
- the inner front part may comprise a flap extending downwardly from an upper margin of the inner front part and abutting an inner surface of the section of the front panel above the perforation line when the lid is in the position where it closes the container.

By the provision of the perforation lines on the side panels sloping downwardly from the rear panel (thereby providing a lid with corresponding sloping), of inner side parts having upper margins downwardly sloping towards the rear panel and of the flap extending downwardly from an upper margin of the inner front part, an easier closing is achieved. The sloping margins in combination with the flap provide a guiding of the lid during its rotation towards closing of the container, which may guide the panels sections of the lid outwardly—and/or guide the inner front part and inner side parts inwardly—so as to at least mitigate the risk of the lid to engage un-intentionally with the inner front and/or the inner side part.

The inner front part may be provided by a panel provided on the inside of the front panel below the perforation line in the front panel, and the inner side parts are provided by panels provided on the inside of the side panels below the perforation line. It is noted that the inner front part and the inner side parts are not necessarily attached to the inside of the side panels and front panel.

In the embodiments comprising a flap as described above, the lid may comprise a ledge provided on the inner surface of the section of the front panel above the perforation line in a position where the lower margin of the downwardly extending flap engages with an upper edge of the ledge, when the lid is in the position where it closes the container.

Furthermore, for such embodiments comprising a flap, a distance may be provided between the upper margin of the inner front part and the inner surface of the top, when the lid is in the position where it closes the container.

Preferably, the corners of the flap and/or the corners of the inner front part are rounded and/or truncated. Typical and preferred size for the truncation is between 70 and 30°, preferably between 60 and 40°, most preferably around 45°.

A vertical distance may be provided between the upper most part of the inner side parts and the upper margin of the inner front part from which the flap extends downwardly, so that the upper margin of the inner front part is provided at a higher position than the upper most part of the inner side parts.

The container may preferably be made from paper, cardboard, metal and/or plastic, or of a laminate thereof, depending of the intended use of the container, including whether or not the product being stored therein is contained in a pouch. Most preferably, the container is made of paper and/or cardboard.

The container may be made from one or more sheet of material being folded and glued and/or welded to form the container.

The container may contain at least one pouch stored inside the container, which pouch is accessible after opening the lid. This may be desired e.g. for products requiring better protection against moisture than what can be provided by the container itself during transportation, storage and after opening of the container. It may also ensure better protection of the content in case the container is damaged during transportation. The container may be used for storing two or more pouches so that part of the content can be assessed at a time, e.g. to prolong the shelf life if the product needs to be protected against air and moisture for as long as possible.

A second aspect of the invention relates to the use of a container as described above for storing of a food product. Such a use may e.g. be for storing of milk powder.

The first and second aspects of the present invention may each be combined. These and other aspects of the invention will be apparent from and elucidated with reference to the embodiments described hereinafter.

The invention further provides a method of producing a container of the invention, the method comprising folding the panels from one piece of material or joining separate sheets of material.

The invention further provides for the use of a container of the invention for storing of a food product. Such food product is preferably milk powder. Most preferably it is an infant formula powder.

BRIEF DESCRIPTION OF THE FIGURES

The container according to the invention will now be described in more detail with regard to the accompanying figures. The figures show one way of implementing the present invention and is not to be construed as being limiting to other possible embodiments falling within the scope of the attached claim set.

DETAILED DESCRIPTION OF AN EMBODIMENT

Figure 1:
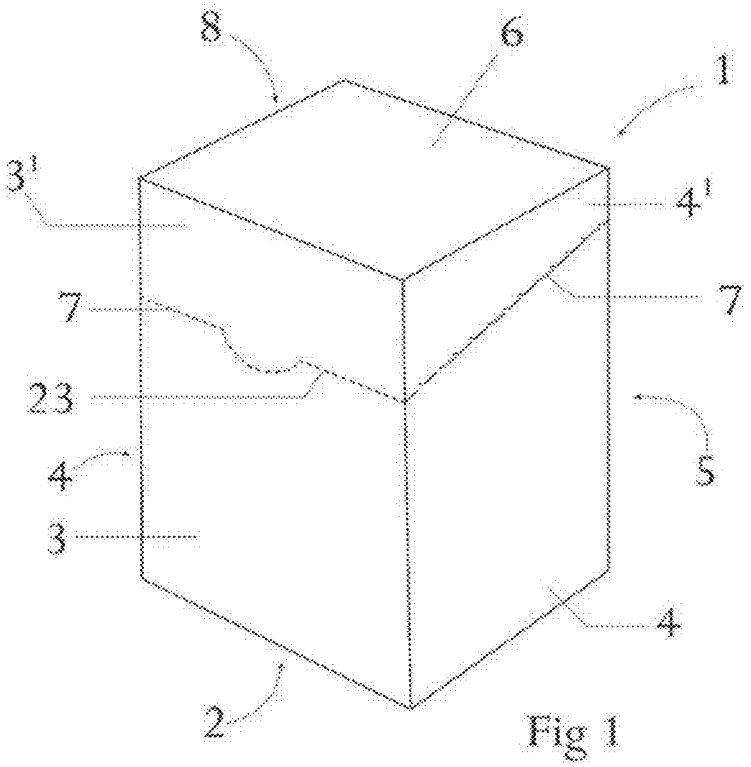
FIG. 1 shows schematically a three-dimensional view of a container according to the present invention before opening.
Figure 2:
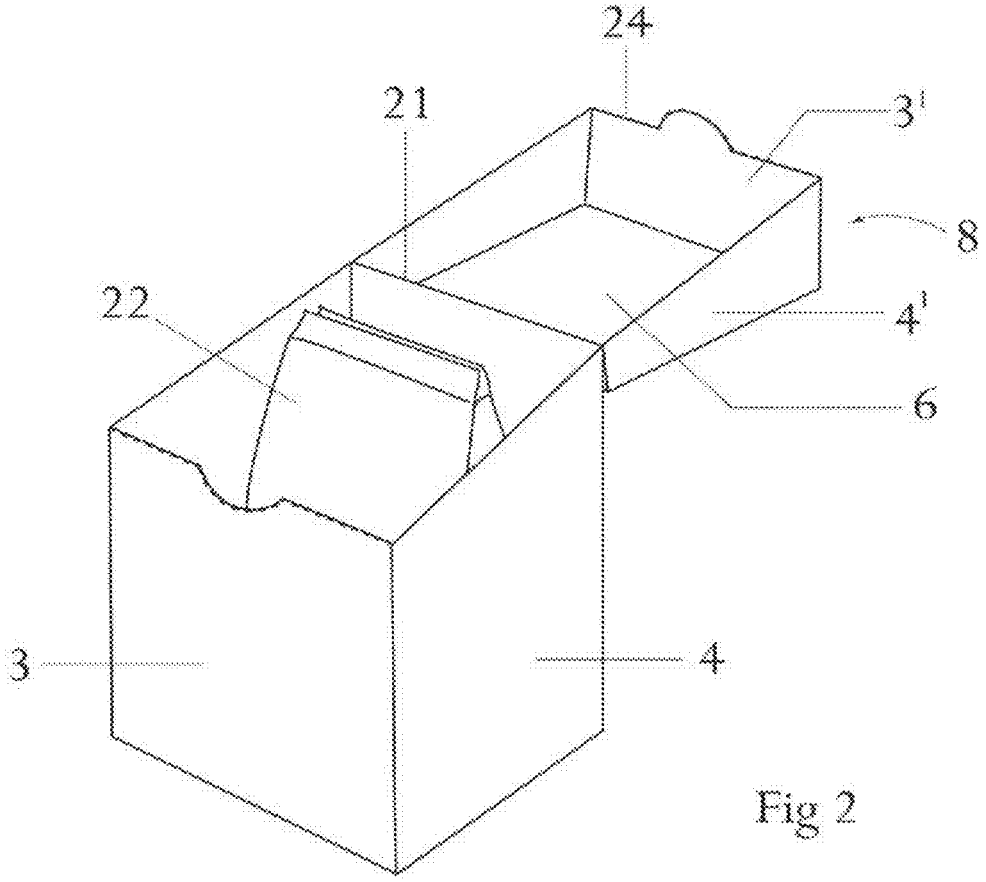
FIG. 2 shows schematically a three-dimensional view of a container according to the present invention with the hingedly connected lid in an open position.

FIG. 1 shows schematically a three-dimensional view of a container 1 according to the present invention before opening, and FIG. 2 shows schematically a three-dimensional view of the container 1 according to the present invention with the hingedly connected lid 8 in an open position. The container 1 comprises a bottom panel 2, a front panel 3, two side panels 4, a rear panel 5, and a top panel 6.

The front panel 3 and the two side panels 4 each comprises a perforation line 7 which is to be broken when opening the container 1 to gain access to the content thereof. As shown in FIG. 1, the perforation lines 7 in the side panels 4 extend from the rear panel 5 to the front panel 3, and the perforation line 7 in the front panel 3 extends between and connects the two perforation lines 7 in the side panels 4. In the embodiments shown in FIGS. 1 and 2, the perforation lines 7 in the side panels 4 are downwardly sloping from the rear panel 5. However, they may in other embodiments be horizontally arranged.

As seen in FIG. 2 showing the container 1 with the lid 8 being opened, the lid 8 comprises the top panel 6 and upper sections 3',4' of the front panel 3 and of the side panels 4 above the perforation lines 7. After the perforation lines 7 have been broken, the lid 8 is rotationally moveable around a folding line 21 in the rear panel 5. The lid 8 is thus moveable between a closing position resembling what is shown in FIG. 1 but with the perforation lines 7 broken, i.e. where the lid 8 closes the container 1, and an open position as shown in FIG. 2, where an open end of the container 1 is not covered by the lid 8.

In the embodiment shown in FIG. 2, the container 1 contains a pouch 22 stored inside the container 1, which pouch 22 is accessible after opening the lid 8. In other embodiments, the container 1 may contain a plurality, such as two, of such pouches.

The perforation line 7 in the front panel 3 is a row of perforations 23 arranged along a line or curve which forms an edge 24 of the lid 8 after the perforations 23 have been broken. In the embodiment shown in FIGS. 1 and 2, the perforations 23 in the front panel 3 are arranged linearly along parts of the path and curved along a middle part in order to ease the manual breaking of the perforations 23.

Figure 3:
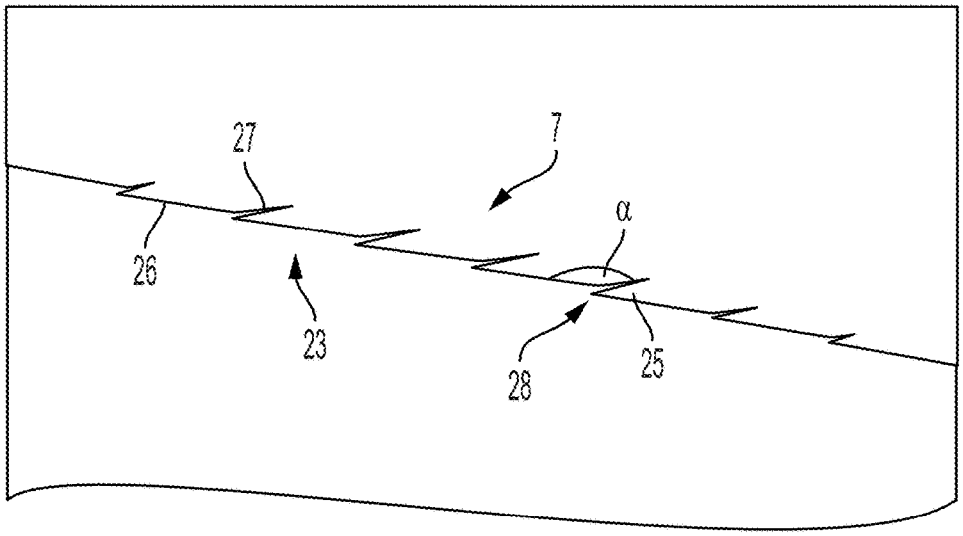
FIG. 3 shows an example of a perforation line on the side panels, the perforation line having tooth-shaped regions.

FIG. 3 shows an example of a design of a perforation line 7 on the side panels 4, the perforation line 7 having tooth-shaped regions 25. The perforation line 7 comprises two coherent first and second cuts 26,27 with a blunt angle (a) there between. These perforations 23 are arranged to provide a row of tooth-shaped regions 25, where each tooth-shaped region 25 is delimited by a first cut 26 and a second cut 27, respectively, from two mutually adjacent but non-coherent perforations 23. The first cuts 26 are arranged parallel to each other but staggered so that they are not arranged along one line. In the embodiments shown in FIGS. 1 and 3, tips 28 of the tooth-shaped regions 25 are directed towards the rear panel 5.

Experiments performed in relation to the present invention have shown that the design of the perforation lines 7 as described above and shown in the figures results in a container 1 which meets the objectives of the present invention as described above.

A container 1 according to the present invention may be made from one or more sheet of material being folded and glued and/or welded to form the container 1. The container 1 can e.g. be made from paper, cardboard, plastic, metal, or laminates thereof depending on the use of the container 1 and depending on whether or not the content is stored in a pouch 22 which can provide further protection.

As a part of the development leading to the present invention, it has been tested how the size of the tooth-shaped regions 25 in the perforation lines 7 in the side panels 4 influence the force needed to tear open these perforations 23 after the perforation line 7 in the front panel 3 has been broken. Containers 1 of the same size but having the following downwardly sloping perforation lines 7 in the side panels 4 were tested: seven teeth, five teeth, and no teeth (i.e. linear perforations). The tests were performed by using a standard tensile testing machine which was opening the container with a defined speed of 100 mm/min. For opening the containers with the tensile testing machine, a hole was cut through each of the lids of the containers, and a wire connected to the load cell was guided through this hole. The test set-up used is shown in FIG. 4.*a*.

Figure 4:
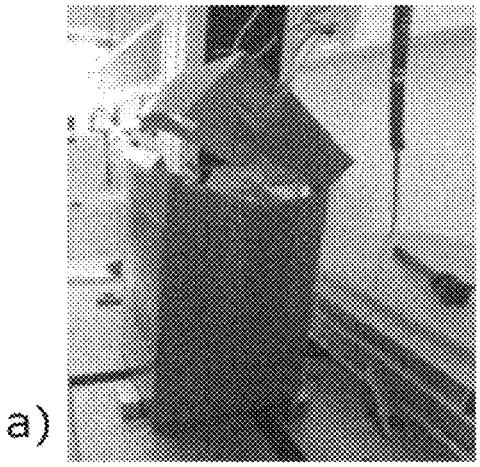
FIG. 4 shows results of tests made to study the force needed to open containers having different types of perforation lines, and different numbers of tooth-shaped regions.
Figure 4:
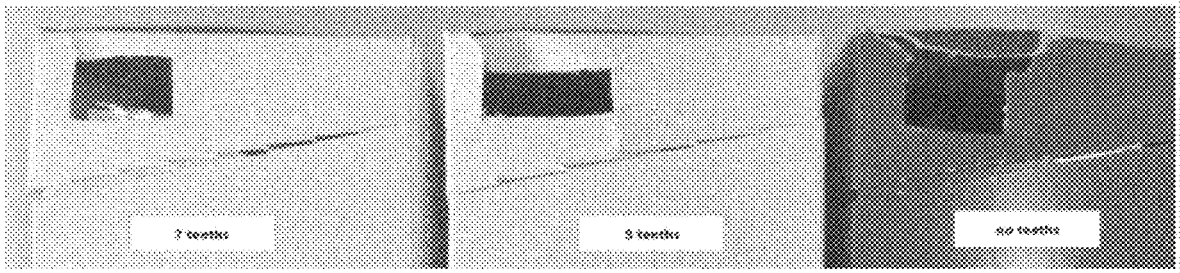

FIG. 4.*b* shows representative examples of how containers 1 with the three different types of perforation lines 7 looked after testing, i.e. with seven, five and no teeth, respectively. The results of the tests are shown in FIGS. 4.*c* and 4.*d* for the five to six samples tested for each perforation line design. FIG. 4.*c* shows the test curves with the opening distance measured in mm along the x-axis and the applied load measured in N along the y-axis. FIG. 4.*d* shows the corresponding loads measured as necessary to fully open the perforation lines. The results show that the average force needed to break the perforations 23 and thereby open the lid 8 is highest for the design with no teeth (i.e. with linear perforations) and lowest for the design with seven teeth. Correspondingly, FIG. 4.*b* shows a significantly larger damage around the area where the force was applied for the sample with no teeth than for the other samples. For the sample with seven teeth, very limited damage is seen at the area where the force was applied. This indicates that this perforation line is easier opened.

Figure 5:
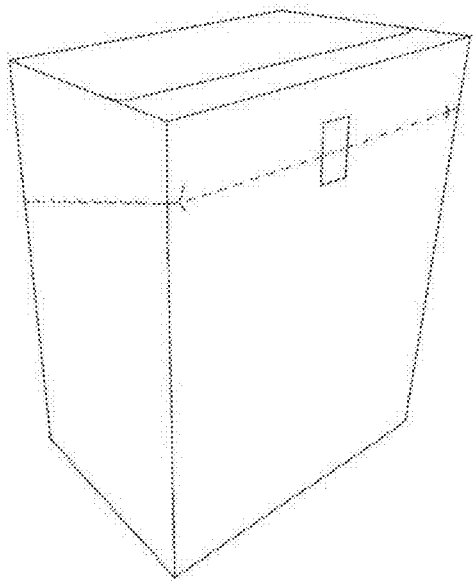
FIG. 5 shows schematically an embodiment of the invention comprising means to provide improved resistance against bulging of the rear panel and breakage of the folding line during opening of the lid of the container.
Figure 6:
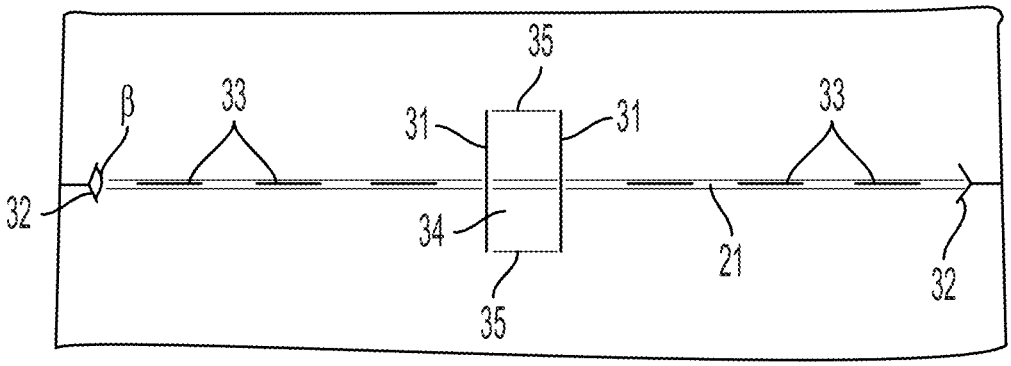
FIG. 6 shows a rear view of the folding line of a closed container as the one in FIG. 5.

FIG. 5 shows schematically an embodiment of the invention comprising means to provide improved resistance against bulging of the rear panel 5 and breakage of the folding line 21 during opening of the lid 8 of the container 1. FIG. 6 shows a rear view of the folding line of a closed container as the one in FIG. 5 to more clearly show the various cuts and perforations. The various features are numbered in FIG. 6 only, to provide a clearer view in FIG. 5.

As shown in FIG. 6, the container 1 comprises two parallel and spaced apart transverse cuts 31 which are provided at or near a central part of the folding line 21. These transverse cuts 31 perforate the rear panel 5 through the thickness, and they typically extend substantially symmetrically across and perpendicular to the folding line 21.

As further shown in FIG. 6, end cuts 32 are arranged near but at a distance from each end of the folding line 21. These end cuts 32 go through the thickness of the rear panel 5, and the folding line 21 is perforated between the end cuts 32 and the end of the folding line 21 adjacent to the side panels 4. Each of the end cuts 32 preferably extends substantially symmetrically across the folding line 21. Such transverse cuts 31 and end cuts 32 have been found to significantly reduce the bulging of the rear panel 5 when the lid 8 is opened and thus reduce the damage of the container 1 especially during repeated opening.

In some embodiments of the invention, including the one shown in FIGS. 5 and 6, the folding line comprises a row of discontinuous perforations 33 extending along the folding line 21. This has been found to reduce the re-closing force when the container 1 has been opened. These perforations 33 may further ease the first opening of the lid 8 along the folding line 21 and thereby reduce the risk of bulging which could otherwise induce damage to the folding line 21 as described above.

Figure 7:
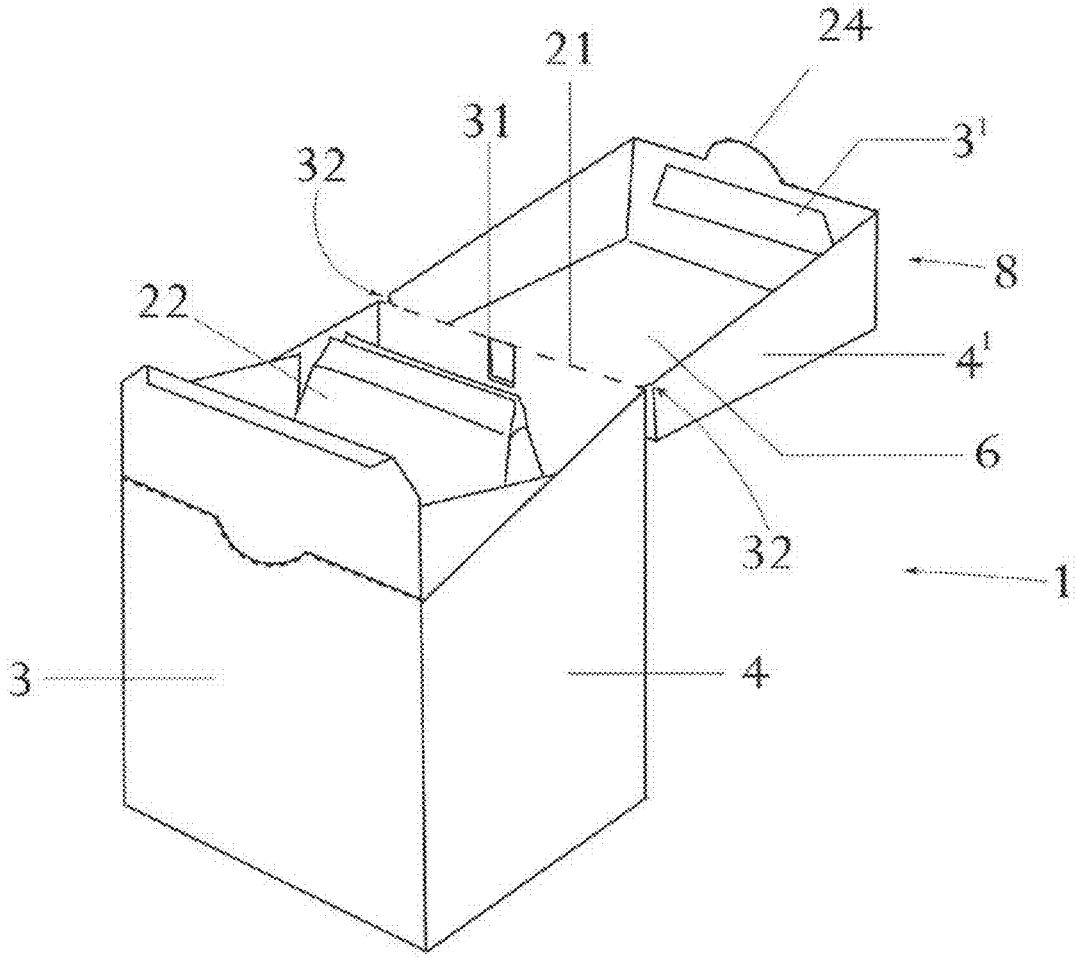
FIG. 7 shows another embodiment of the present invention comprising means for improved re-closing properties of the container.
Figure 8:
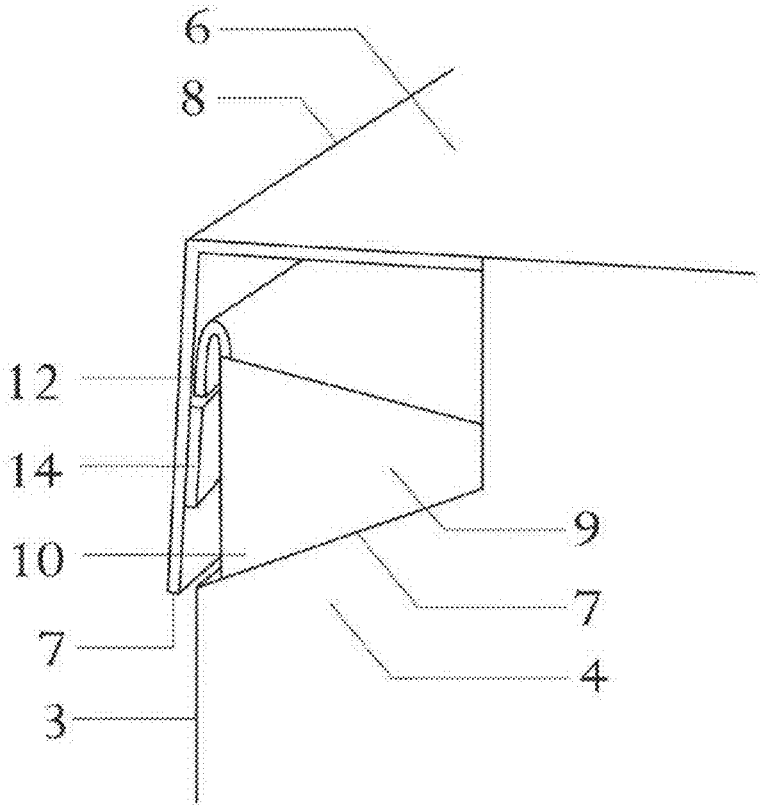
FIG. 8 is a close-up perspective and schematic illustration of a section of the container of FIG. 7; the section is shown with some material removed to reveal a part of the interior container.
Figure 9:
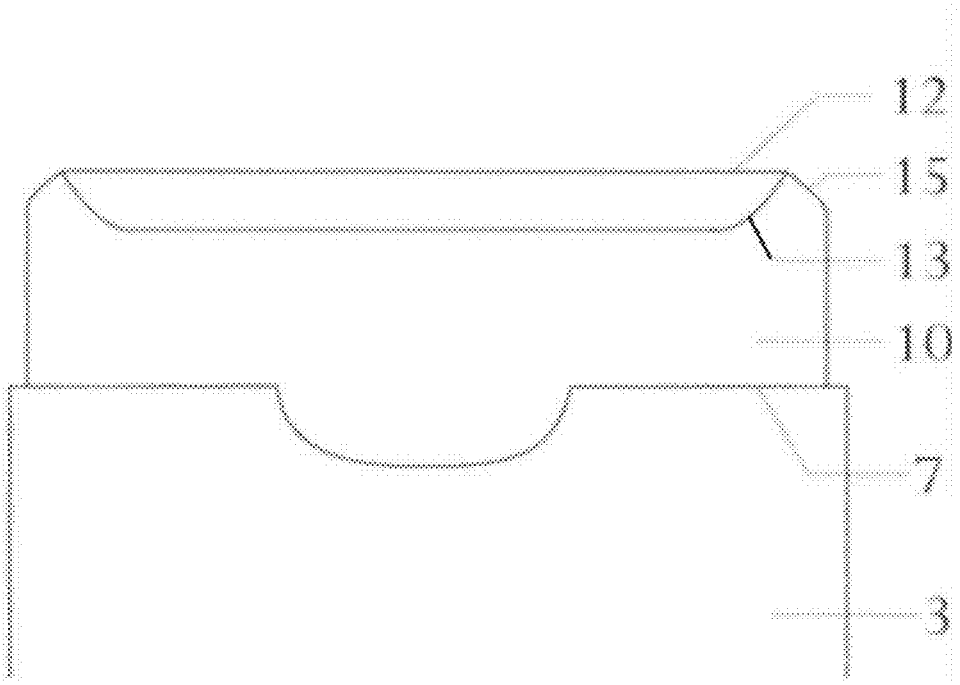
FIG. 9 is a schematic illustration of a region of the container in FIG. 7, the container is illustrated from the front, and only the inner front part and a part of the front panel is disclosed.

FIG. 7 shows another embodiment of the present invention comprising means for improved re-closing properties of the container 1. FIG. 8 is a close-up perspective and schematic illustration of a section of the container 1 of FIG. 7; the section is shown with some material removed to reveal a part of the interior container. FIG. 9 is a schematic illustration of a region of the container in FIG. 7, the container is illustrated from the front, and only the inner front part and a part of the front panel is disclosed.

In order to provide an easy reclosing of the container 1, the front panel 3 in the embodiment in FIGS. 7-9 comprises an inner front part 10 extending above the division line 7 in the front panel 3 without being attached to the front panel 3 above the division line 7. Further, each side panel 4 comprises an inner side part 9 extending above the division line 7 in the side panel 4 without being attached to the side panel 4 above the division line 7. Advantageously, the upper margin of each of the inner side parts 9 extends downwardly sloping towards the rear panel 5, as shown in FIG. 7. This downward sloping towards the rear panel 5 may be seen as providing a guide which prevents the sections 4' from engaging un-intentionally with inner side part 9.

While the inner side parts 9 reduce the risk of un-intentional engagement of the sections 4', the section 3' may still be prone to un-intentional engagement with the inner front part 10. In order to further reduce this risk, the inner front part 10 comprises a flap 12 (see FIG. 8) extending downwardly from an upper margin of the inner front part 10. This flap 12 is arranged so that it abuts an inner surface of the section 3' of the front panel 3 above the division line 7 when the lid 8 is in the position where it closes the container 1. In the situation, where the lid 8 is in the position where the container is open, the flap 12 extends downwardly and outwardly, where the outwardly extending typically is provided by the material being resilient and the flap is provided by folding along a folding line which after folding is the upper margin of the inner front part 10.

As seen in FIG. 8, there is provided a vertical distance between the upper most part of the inner side part 9 and the upper margin of the inner front part 10 from which the flap 12 extends downwardly. Thus, the upper margin of the inner front part 10 is higher than the upper most part of the inner side parts 9. This assists in an easy reclosing of the container, as the lid when moved towards it closing position will initially be guided by flap 12 to deflect the section 3' outwardly and/or the inner front part 10 inwardly.

When the lid 8 is moved from the open position shown in FIG. 7 to the closed position, after section 3' meets the inner front part 10, thus guiding the section 3' outwardly and/or the inner front section 10 inwardly, the upper margins of the inner side parts 9 will in turn guide the sections 4' outwardly and/or the sections 4' will guide the inner side parts 9 inwardly Thereby an easy reclosing of the container 1 is provided.

In a preferred embodiment, the inner front part 10 is provided by a panel provided on the inside of the front panel 3 below the division line 7 in the front panel 3, and the inner side parts 9 are provided by panels provided on the inside of the side panels 4 below the division line 7. Such panels may be separate panels which are attached to the inside of the panels of the container 1, e.g. by gluing and/or welding. However, in some preferred embodiments, the panels used as inner side parts 9 and inner front part 10 is made from a single sheet being folded into an insert so as to fit inside the container. It is further noted that in the latter case, the folded single sheet may not need to be attached to the inside of the container as it may be given a longitudinal extension so that it may rest at the bottom panel 2 of the container. However, also in this case, it may be advantageous to attach the inset to the inside of the container 1.

It is often preferred that the container is prevented from being opened un-intentionally and a locking mechanism is often preferred, which locking mechanism should preferably provide a tactile and/or a hearable response to inform the user that the container is closed and locked. To this, the the lid 8 may be provided with a ledge 14 provided on the inner surface of the section 3' of the front panel 3 above the division line 7 in a position where the lower margin of the downwardly extending flap 12 engages with an upper edge of the ledge 14, when the lid 8 is in the position where it closes the container 1.

Thereby, the flap 12 will, when the lid 8 is to be positioned in the closed position, bend inwardly and/or the section 3' will bend outwardly until the flap 12 is able to bend outwardly. This may provide a snapping of the flap 12 which, depending on the strength of the material used for the container, provide a hearable and/or a tactile snap. The position at which the container is locked is shown in FIG. 8, which illustrates the interior of the container at an upper corner with a part of the section 4' cut away for illustration only.

In order to e.g. provide sufficient space for maneuvering the flap 12 into the position where it engages with the ledge 14, the ledge 14 and the flap 12 are mutually arranged so as to provide a distance between the upper margin of the inner front part 10 and the inner surface of the top 6, when the lid 8 is in the position where it closes the container 1.

In order to further facilitate easy reclosing of the container, sharp and/or pointing corners could advantageously be removed, and in the preferred embodiment shown in FIGS. 7-9, the corners 13 of the flap 12 and/or corners 15 of the inner front part 10 are preferably rounded and/or truncated as shown in FIG. 9. Typical size for the truncation is 45 degrees as shown in FIG. 9, where the corners 15 of the inner front part 10 and the corners 13 of the flap 12 are truncated. In addition, in the embodiment shown in FIG. 9 the corners are furthermore rounded; such roundings may be omitted.

Although the present invention has been described in connection with the specified embodiments, it should not be construed as being in any way limited to the presented examples. The scope of the present invention is set out by the accompanying claim set. In the context of the claims, the terms "comprising" or "comprises" do not exclude other possible elements or steps. Also, the mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

The invention claimed is:

1. A container comprising a bottom panel, a front panel, two side panels, a rear panel, and a top panel wherein:

the front panel and the two side panels each comprises a perforation line;

the perforation lines in the side panels extend from the rear panel to the front panel, and the perforation line in the front panel extends between and connects the two perforation lines in each of the side panels;

a lid comprises the top panel and upper sections of the front panel and of the side panels, respectively, above the perforation lines, the lid configured to be, after the perforation lines have been broken, rotationally moveable around a folding line in the rear panel between a closing position where the lid closes the container, and an open position where an open end of the container is not covered by the lid, wherein the folding line comprises a row of discontinuous perforations extending along the folding line;

the perforation line in the front panel is a row of perforations arranged along a line or a curve, the line or curve forms an edge of the lid after the perforations have been broken;

each of the perforation lines in the side panels is a row of perforations each comprising two coherent first and second cuts with a blunt angle therebetween, the row of perforations being arranged to provide a row of tooth-shaped regions, each tooth-shaped region is delimited by a first cut and a second cut, respectively, from two mutually adjacent but non-coherent perforations and each tooth shaped region is positioned such that a narrowest end of each tooth shaped region is directed towards the rear panel; and the first cuts are arranged parallel to each other but staggered so that they are not arranged along one line.

2. The container according to claim 1, wherein the blunt angle between first and second cuts of the perforations in the side panels is between 145° and 175°.

3. The container according to claim 1, wherein a smallest distance between two perforations on the side panels is between 0.5 and 3 mm.

4. The container according to claim 1, wherein a length of the first cuts of the perforations on the side panels is between 8 and 16 mm.

5. The container according to claim 1, wherein the perforation lines in each of the side panels are downwardly sloping from the rear panel.

6. The container according to claim 5, wherein:

the front panel further comprises an inner front part extending above the perforation line in the front panel without being attached to the front panel above the perforation line;

each side panel further comprises an inner side part extending above the perforation line in the side panel without being attached to the side panel above the perforation line, the upper margin of each of the inner side parts extending downwardly sloping towards the rear panel; and the inner front part comprises a flap extending downwardly from an upper margin of the inner front part and abutting an inner surface of the section of the front panel above the perforation line when the lid is in the closing position.

7. The container according to claim 6, wherein the corners of the flap and/or the corners of the inner front part are rounded and/or truncated.

8. The container according to claim 6, wherein a vertical distance is provided between the upper most part of the inner side parts and the upper margin of the inner front part from which the flap extends downwardly, so that the upper margin of the inner front part is provided at a higher position than the upper most part of the inner side parts.

9. The container according to claim 1, wherein at least two parallel and spaced apart transverse cuts are provided at or near a central part of the folding line, the transverse cuts perforating the rear panel through a thickness of the rear panel, and the transverse cuts extending substantially symmetrically across and perpendicular to the folding line.

10. The container according to claim 1, wherein an end cut is provided at each of a first end and a second end of the folding line, each end cut near but at a distance from each of the first end and the second end of the folding line, the end cuts going through a thickness of the rear panel, and the folding line being perforated between the end cuts and the first end and second end of the folding line.

11. The container according to claim 10, wherein each of the end cuts is provided in the form of two linear and coherent sub-cuts arranged non-perpendicularly to the folding line.

12. The container according to claim 1, wherein a first transverse cut and a second transverse cut are provided at or near a central part of the folding line, the first transverse cut parallel and spaced apart from the second transverse cut, the first transverse cut and the second transverse cut each perforating the rear panel through a thickness of the rear panel and extending substantially symmetrically across and perpendicular to the folding line, and wherein an end cut is provided at each of a first end and a second end of the folding line, each end cut near but at a distance from each of the first end and the second end of the folding line, and wherein the discontinuous perforations extending along the folding line extends between the end cut of the first end and the first transverse cut and extends between the end cut of the second end and the second transverse cut.

13. A method of producing a container, the container comprising a bottom panel, a front panel, two side panels, a rear panel, and a top panel wherein:

the front panel and the two side panels each comprises a perforation line;

the perforation lines in the side panels extend from the rear panel to the front panel, and the perforation line in the front panel extends between and connects the perforation lines in each of the side panels;

a lid comprises the top panel and upper sections of the front panel and of the side panels, respectively, above the perforation lines, the lid configured to be, after the perforation lines have been broken, rotationally moveable around a folding line in the rear panel between a closing position where the lid closes the container, and an open position where an open end of the container is not covered by the lid, wherein the folding line comprises a row of discontinuous perforations extending along the folding line;

the perforation line in the front panel is a row of perforations arranged along a line or a curve, the line or curve forms an edge of the lid after the perforations have been broken;

each of the perforation lines in the side panels is a row of perforations each comprising two coherent first and second cuts with a blunt angle therebetween, the row of perforations being arranged to provide a row of tooth-shaped regions, each tooth-shaped region is delimited by a first cut and a second cut, respectively, from two mutually adjacent but non-coherent perforations and each tooth shaped region is positioned such that a narrowest end of each tooth shaped region is directed towards the rear panel; and the first cuts are arranged parallel to each other but staggered so that they are not arranged along one line, the method comprising: folding the panels from one piece of material or joining separate sheets of material.

14. The method according to claim 13, wherein a first transverse cut and a second transverse cut are provided at or near a central part of the folding line, the first transverse cut parallel and spaced apart from the second transverse cut, the first transverse cut and the second transverse cut each perforating the rear panel through a thickness of the rear panel and extending substantially symmetrically across and perpendicular to the folding line, and wherein an end cut is provided at each of a first end and a second end of the folding line, each end cut near but at a distance from each of the first end and the second end of the folding line, and wherein the discontinuous perforations extending along the folding line extends between the end cut of the first end and the first transverse cut and extends between the end cut of the second end and the second transverse cut.

15. A method for storing of a food product, the method comprising placing food in a container comprising a bottom panel, a front panel, two side panels, a rear panel, and a top panel wherein: the front panel and the two side panels each comprises a perforation line;

the perforation lines in the side panels extend from the rear panel to the front panel, and the perforation line in the front panel extends between and connects the two perforation lines in each of the side panels;

a lid comprises the top panel and upper sections of the front panel and of the side panels, respectively, above the perforation lines, the lid configured to be, after the perforation lines have been broken, rotationally moveable around a folding line in the rear panel between a closing position where the lid closes the container, and an open position where an open end of the container is not covered by the lid, wherein the folding line comprises a row of discontinuous perforations extending along the folding line;

the perforation line in the front panel is a row of perforations arranged along a line or curve, the line or curve forms an edge of the lid after the perforations have been broken;

each of the perforation lines in the side panels is a row of perforations each comprising two coherent first and second cuts with a blunt angle therebetween, the row of perforations being arranged to provide a row of tooth-shaped regions, each tooth-shaped region is delimited by a first cut and a second cut, respectively, from two mutually adjacent but non-coherent perforations and each tooth shaped region is positioned such that a narrowest end of each tooth shaped region is directed towards the rear panel; and the first cuts are arranged parallel to each other but staggered so that they are not arranged along one line.

16. The method according to claim 15, wherein a first transverse cut and a second transverse cut are provided at or near a central part of the folding line, the first transverse cut parallel and spaced apart from the second transverse cut, the first transverse cut and the second transverse cut each perforating the rear panel through a thickness of the rear panel and extending substantially symmetrically across and perpendicular to the folding line, and wherein an end cut is provided at each of a first end and a second end of the folding line, each end cut near but at a distance from each of the first end and the second end of the folding line, and wherein the discontinuous perforations extending along the folding line extends between the end cut of the first end and the first transverse cut and extends between the end cut of the second end and the second transverse cut.

* * * * *